United States Patent [19]

Stern et al.

[11] 4,019,981

[45] Apr. 26, 1977

[54] METHOD AND APPARATUS FOR THE PREPARATION OF MINERAL MIXTURES ON A JIG CONTROLLED BY COMPRESSED AIR

[75] Inventors: Hanns Stern, Dortmund-Hoechsten; Alexander Lotz, Wengern-Ruhr, both of Germany

[73] Assignee: Klockner-Humboldt-Deutz Aktiengesellschaft, Germany

[22] Filed: Dec. 1, 1975

[21] Appl. No.: 636,607

Related U.S. Application Data

[63] Continuation of Ser. No. 515,922, Oct. 18, 1974, abandoned.

[30] Foreign Application Priority Data

Oct. 20, 1973 Germany ..... 2352798

[52] U.S. Cl. ..... 209/455; 209/457; 209/500

[51] Int. Cl.[2] ..... B03B 5/24

[58] Field of Search ..... 137/487.5, 624.15, 624.13, 137/627.5, 624.17; 251/129, 137; 209/504, 502, 500, 475, 476, 468, 469, 425–427, 455–457

[56] References Cited

UNITED STATES PATENTS

| | | | |
|---|---|---|---|
| 3,252,574 | 5/1966 | De Koning et al. | 209/457 |
| 3,307,824 | 3/1967 | Weisheit | 137/487.5 X |
| 3,446,471 | 5/1969 | Westphal | 251/129 X |
| 3,446,473 | 5/1969 | Barker | 251/129 X |
| 3,523,677 | 8/1970 | North | 251/129 X |
| 3,800,794 | 4/1974 | Georgi | 137/487.5 X |

*Primary Examiner*—Frank W. Lutter
*Assistant Examiner*—Ralph J. Hill
*Attorney, Agent, or Firm*—Hill, Gross, Simpson, Van Santen, Steadman, Chiara & Simpson

[57] ABSTRACT

A method and apparatus for the preparation of mineral mixtures, particularly of rough washed coal, on a jig which is controlled by compressed air in which the separating liquid, with the aid of control valves arranged in the supply conduits for air and/or separating liquid, is moved periodically up and down through the openings in the settling material carrier, wherein the pulsating movement of the separating liquid is effected with the aid of an electronic valve impulse control of the compressed air and/or the quantity of separating liquid conveyed to the settling tank.

6 Claims, 1 Drawing Figure

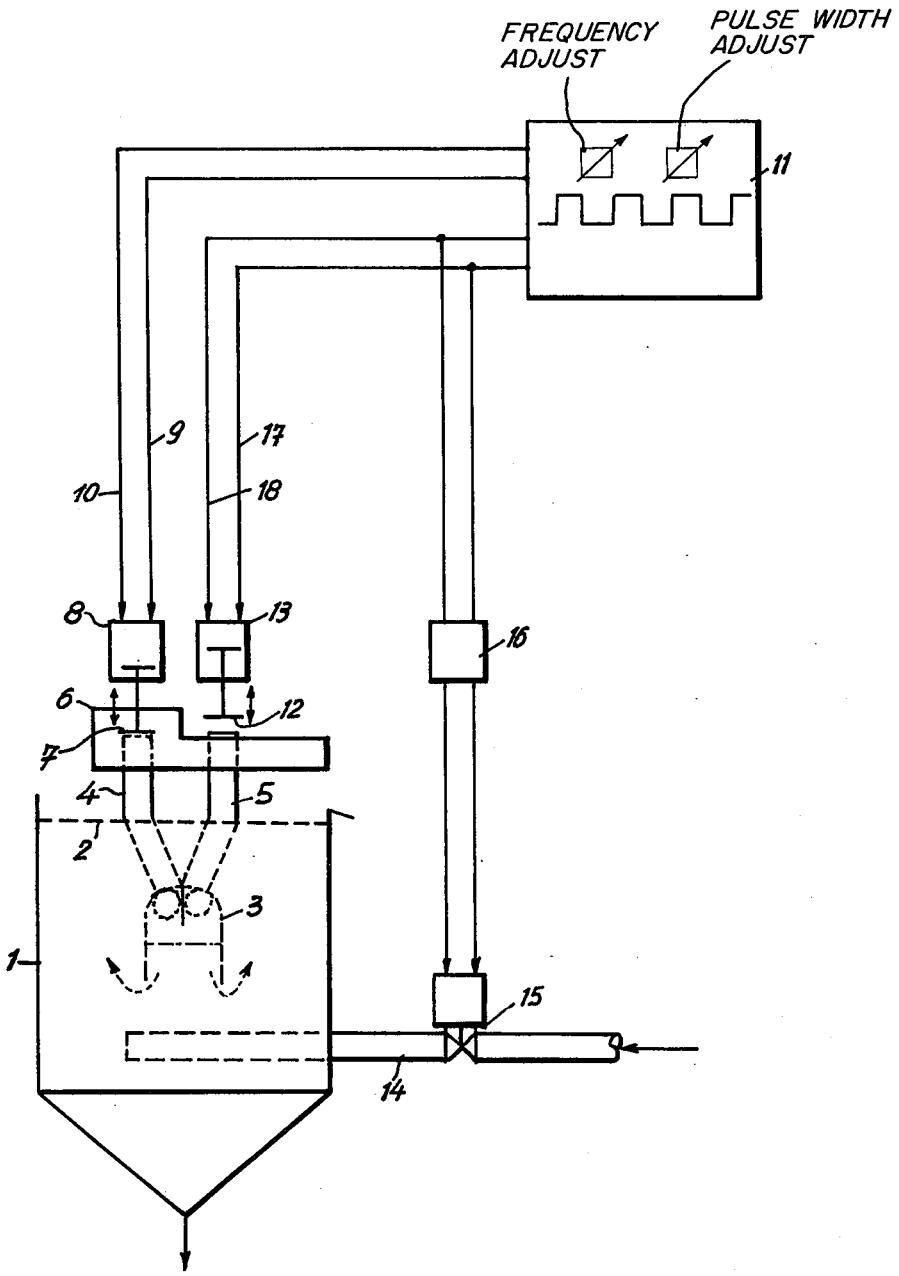
FREQUENCY ADJUST
PULSE WIDTH ADJUST
11
9
17
10
18
8
13
16
6
12
7
4
5
2
3
1
15
14

METHOD AND APPARATUS FOR THE PREPARATION OF MINERAL MIXTURES ON A JIG CONTROLLED BY COMPRESSED AIR

This is a continuation of application Ser. No. 515,922, filed Oct. 18, 1974, now abandoned.

BACKGROUND OF THE INVENTION

1. Field of the Invention

The invention relates to a method and apparatus for the preparation of mineral mixtures, particularly of rough washed coal, in a jig controlled by compressed air, and more particularly to techniques for moving the separating liquid up and down periodically through the openings of the settling material carrier with the aid of control valves arranged in the feed conduits for air and/or separating liquid.

2. Description of the Prior Art

Techniques for preparing mineral mixtures in a jig are well known in the art, in the German published patent application No. 1,147,542, the control of valves arranged in the feed conduits for air is effected with the aid of a rotating cam shaft which periodically opens and closes the valves. In this known valve control, however, it is disadvantageous that an adjustment of the chance of the cam shaft must be undertaken in order to change the frequency of the settling thrust necessary for the settling operation. This leads to undesirable interruptions in the operation of the settling tank, as the adjustment of the cam shaft cannot be undertaken during operation of the apparatus. The same holds ture for the jig valve operation disclosed in U.S. Pat. No. 3,252,574.

SUMMARY OF THE INVENTION

The object of the present invention, therefore, is to provide a method and apparatus for the preparation of mineral mixtures in a jig which is controlled by compressed air, which method and apparatus makes it possible to stepless regulation of the frequency of the settling thrust and of the amplitude of the pulsating movement of the separating liquid during operation of the jig.

The above object is achieved through techniques wherein the pulsating movement of the separating liquid is provided with the aid of an electronic valve control for the compressed air and/or for the quantity of separating liquid supplied to the jig. According to the invention, the frequency of the settling thrust may be advantageous adjusted in a simple manner, with the aid of the electronic valve control, by a corresponding alteration of the impulses provided by an impulse supply of the electronic valve control, accurately as to the desired frequency of the settling thrust in each case. Inasmuch as the amplitude and the intensity, respectively, of the pulsation of the separating liquid is dependent on how long the control valve arranged in the air or separating conduits is held in an open condition, the electronic valve control, according to the invention, also makes possible an alteration in the intensity of the pulsating movement of the separating liquid in the jig by means of alteration of the time that the valve is held open.

In an advantageous further development of the invention, a retardation of the settling operation may be provided so that, very advantageously, the specifically heavier material present settles in a lower-most layer on the carried while specific lighter materials are deposited in likewise coherent layers thereabove, depending on the respective specific gravities, so that the layers may be easily separated from one another at the end of the material carrier with the aid of a slide, scraper or the like which is actuated by a float mechanism.

BRIEF DESCRIPTION OF THE DRAWING

Other objects, features and advantages of the invention, its organization, construction and operation will be best understood from the following detailed description taken in conjunction with the accompanying drawing, on which there is a single diagrammatic representation of a jig which is controlled in accordance with the present invention.

DESCRIPTION OF THE PREFERRED EMBODIMENT

Referring to the drawing, a jig or wet settling tank 1 is diagrammatically illustrated as including a settling material carrier 2 beneath which is located an air chamber 3. The air chamber 3 is in open communication on its lower side with the separating liquid and extends over the entire width of the settling tank 1. Compressed air is discharged into the chamber 3 from above by way of the compressed air conduits 4 and 5. The compressed air conduit 4 is connected in fluid communication with a compressed air container 6 which functions as the supply of compressed air for the system. A plate valve 7 is located at the mouth of the conduit 4 within the air container 6 and is connected with a control mechanism 8 which is attached through conduits 9 and 10 with an electronically controlled impulse supply 11. The control mechanism 8 may be an electrically operated mechanism, the electronically controlled impulse supply then being constituted by a pulse generator. As illustrated on the drawing, the control mechanism 8 is connected to the supply 11 by way of a pair of electrical conduits 9 and 10. The compressed air conduit 5, which serves to vent the chamber 3, is likewise provided with a plate valve 12 which is actuated by a control mechanism 13. The control mechanism 13 is also connected to the supply 11 by way of a pair of electrical conduits 17 and 18.

A conduit 14 is connected in fluid communication in the lower area of the settling tank 1 for feeding liquid into the settling tank, which liquid is introduced upwardly to beyond the center of the container. A locking valve 15 is serially interposed in the conduit 14 for controlling the feed of separating liquid into the tank of the jig. The valve 15 is connected for operation by the supply 11 through the intermediary of a time delay circuit 16, for example a time delay relay. Advantageously, the time delay 16 is connected to the same control conduit 17 and 18 which supply control pulses to the control mechanism 13 for the plate valve 12.

Although not illustrated in the drawing, it is to be understood that the control mechanisms 8 and 13 and the locking valve 15 may be connected to air lines for pneumatic actuation under the control of electrically operated solenoid valves.

In operation of the jig, a periodic opening and closing of the plate valve 7 is provided to periodically inject compressed air through the compressed air conduit 4 into the pressure chamber 3. Through the quantity of air entering in each case into the pressure chamber 3, the separating liquid present in the chamber 3 is forced downwardly. The liquid issuing from the chamber 3 in each case in the direction of the broken arrows brings about an upwardly directed impulse-type flow of the separating liquid through the openings in the settling material carrier 2. The materials to be separated friom one another, which are deposited on the carrier 2, are grasped and lifted upwardly by the upwardly directed flow of the separating liquid.

After each impulse of compressed air, the plate valve 7 is closed and the plate valve 12, constructed as a ventilation valve, is opened with corresponding timely retardation. The opening and closing of the plate valves 7 and 12 in a timed sequence takes place with the aid of the control mechanisms 8 and 13 (preferably pneumatically operated), and yet depending on the pulses supplied by the electronic impulse supply 11. If the timed sequence of pulses from the electronic impulse supply 11, and therewith the opening and closing times of the valve, may be adjusted as desired, a very advantageous possibility arises for regulating separation and settling through changes in frequency of the settling thrust as well as changes in the intensity of the pulsation of the liquid, so that the settling operation in the tank may be adjusted for an optimum separating effect. For a better understanding of the invention, attention is invited that changes of the frequency of the settling thrust are carried out by corresponding timely acceleration and retardation, accurately determined as to one another, of the upward and downward movement of the plate valves 7 and 12, while the changes in intensity of the pulsation of the separating liquid takes place by means of corresponding changes of the open and closed times of the plate valves 7 and 12.

Depending on the particular application, it may also be suitable, and advantageous, according to the composition of the materials to be separated, to carry out a retardation of the particular lowering operation of the layer of material onto the carrier 2, in order to provide the materials on the carrier the possibility of depositing themselves, corresponding to their similarity, in layers on the settling material carrier. In order to attain a timely retardation of the particular settling operation of the layer (or layers) on the settling material carrier, it is advantageous to operate the valve 15 of the feed conduit 14 through a time delay, such as a time delay relay 16, and in parallel with the control mechanism 13 of the plate valve 12, so that the sequence of pulses provided by the supply 11 to the control mechanism 13 is utilized, with a time delay provided by the time delay relay 16, to also operate the control mechanism of the valve 15. By this technique, both of the valves 12 and 15 are controlled by means of the pulses supplied by the supply 11 in respect of the closing and the opening directions in a similar manner. The closure movement of both valves takes place properly at the same time. Upon the opening operation, however, the valve 15 is actuated with a slight retardation by virtue of the time delay circuit 16. In this manner the feeding of separating liquid into the settling tank is increased and thereby a slight, however not to strong, of a retardation in the particular lowering operation of the separation liquid and accordingly the layer of material on the settling material carrier is introduced. With this technique, and in a very advantageous manner without interruption of the operation of any time, the settling operation of the materials to be separated from one another on the settling material carrier may be influenced and an optimum settling or separating effect may be attained.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In a method of preparing mineral mixtures wherein a separating liquid is moved upwardly and downwardly in a settling tank of a jig through the material supported on a perforate carrier by feeding compressed air into and venting an air chamber located within the settling tank to cause up and down pulsation of the liquid, the chamber having air feed and vent lines, and wherein the tank has a separating liquid feed line with a valve therein to introduce separating liquid into the tank, the improvement comprising the steps of:

generating electrical pulses corresponding to the desired up and down movement of the liquids:

applying the electrical pulses to valve control mechanisms of feed and vent valves in the feed and vent valves in accordance with a predetermined time sequence; and opening the separating liquid valve after opening of the vent valve to introduce separating liquid and retard the settling of separating liquid downwardly through the material.

2. The improved method of claim 1, comprising the further step of:

delaying the opening of the separating liquid valve for a predetermined interval after the opening of the vent valve.

3. In jig apparatus for preparing mineral mixtures wherein material to be separated is supported on a perforate carrier at the upper end of a settling tank having a separating liquid therein and an air chamber disposed in the liquid and communicating on a lower side with the liquid, and wherein an air feed line is connected to the chamber and to a compressed air supply through an air feed valve and a vent line is connected to the chamber and to the atmosphere through a vent valve, and opening and closing of the valves causes pulsation of the liquid up and down through the material on the carrier, and wherein the settling tank has a separating liquid line with a liquid feed valve therein, the improvement comprising:

an electrically controlled feed valve actuating device connected to said air feed valve:

an electrically controlled vent valve actuating device connected to said vent valve;

an electrical pulse supply connected to said actuating devices for operating said air feed and vent valves in accordance with a predetermined time sequence;

an electrically controlled liquid feed valve actuating device; and a delay circuit connected to said liquid feed valve actuating device and connected in parallel with said vent valve actuating device to delay the opening of said liquid feed valve for a predetermined period after the opening of said vent valve, the feeding of additional separating liquid causing retardation in the downward movement of the liquid through the material and the carrier.

4. A jig for mineral mixtures, comprising:

a settling tank for holding, and supporting an upward and downward flow of, separating liquid;

a perforate material carrier supported at the upper end of said tank for receiving and supporting material to be separated;

an air chamber within and extending across the width of said tank, said air chamber including a closed top wall, side walls extending downwardly through the separating liquid, and an open bottom for communication with the separating liquid;

an air feed line connected to said chamber, and an air feed valve connecting said feed line to a compressed air supply;

a vent line connected to said chamber and a vent valve connecting said chamber in communication with the atmosphere;

an electrically controlled air feed valve actuator connected to said feed valve;

an electrically controlled vent valve actuator connected to said vent valve;

an electrical pulse supply for generating first and second pulse trains, said air feed valve actuator connected to receive said first pulse train, said vent valve actuator connected to receive said second pulse train, and the pulses of said first and second pulse trains timed with respect to one another to define a desired opening and closing sequence for said air feed and vent valves, the sequential opening and closing of said air feed and vent valves causing an upward and downward pulsating flow of separating liquid through the material supported on said carrier;

a separating liquid feed line connecting said tank to a separating liquid supply;

a separating liquid feed valve in said separating liquid feed line; and an electrically controlled liquid feed valve actuating means connected to said liquid feed valve and connected to said electrical pulse supply to receive said second pulse train, said liquid feed valve operated to feed separating liquid into said tank during venting to cause retardation in the downward movement of the liquid.

5. A jig according to claim 4, wherein said liquid feed valve actuating means comprises a time delay circuit operable to delay opening of said liquid feed valve for a predetermined interval after the opening of said vent valve.

6. A jig according to claim 5, wherein said time delay circuit comprises a time delay relay.

* * * * *